United States Patent [19]

Miller

[11] 3,987,752

[45] Oct. 26, 1976

[54] APPARATUS FOR DISPENSING ELONGATE FLEXIBLE MATERIAL

[75] Inventor: Ward B. Miller, Waterville, Ohio

[73] Assignee: Owens-Corning Fiberglas Corporation, Toledo, Ohio

[22] Filed: May 5, 1975

[21] Appl. No.: 574,679

[52] U.S. Cl. ..... 118/42; 118/50; 118/239; 118/266; 118/255; 83/155; 53/118

[51] Int. Cl.[2] ..... B05C 11/00; B05C 1/06

[58] Field of Search ..... 118/40, 255, 41, 50, 118/42, 239, 266, 264; 83/650, 272, 155; 198/32; 156/539, 557; 53/137, 118

[56] References Cited

UNITED STATES PATENTS

| | | | |
|---|---|---|---|
| 2,841,305 | 7/1958 | Werner | 118/41 X |
| 2,893,191 | 7/1959 | Lancaster | 118/42 X |
| 3,029,161 | 4/1962 | Ferner | 118/266 X |
| 3,266,354 | 8/1966 | Ortner | 118/42 X |
| 3,580,141 | 5/1971 | Richter | 198/32 X |

*Primary Examiner*—John P. McIntosh
*Attorney, Agent, or Firm*—John W. Overman; Allen D. Gutchess, Jr.

[57] ABSTRACT

Apparatus is provided for dispensing tape for wrapping around insulation in roll form to hold the insulation in a compressed state. Machines are now known for forming elongate strips of insulation into tightly-wrapped packages. As the last portions of the strips are being wound, tapes are applied around the outer surfaces to hold the strips in the compressed, packaged state. Vapor barriers or backing sheets are sometimes applied to the outer surfaces of the insulating strips prior to the application of the tapes, or the tapes can be applied directly to the outer surfaces of the strips. In the latter instance, at least two tapes are employed for each package of insulation. The tapes are supplied by dispensers which are located adjacent a supply conveyor that feeds the insulating strips into the packaging machine. The new dispensers are designed to be located at substantially any position across the conveyor and the dispensers can also be located close together. The new dispensers thus can be used with a variety of widths of insulating strips which are packaged in side-by-side relationship in the packaging machine.

31 Claims, 7 Drawing Figures

APPARATUS FOR DISPENSING ELONGATE FLEXIBLE MATERIAL

This invention relates to dispensers for elongate, flexible material and particularly to dispensers for supplying tapes to strips of insulation being packaged in roll form in a packaging machine.

Strips of insulation are now commonly packaged in a spiral in a roll or cylindrical form. Machines are also now known for packaging strips of insulation as two or more are received in side-by-side relationship from the end of a forming line. Each package can contain one long strip or a number of shorter strips or batts located in end-to-end relationship. In many instances, vapor barriers or backing sheets are applied to the insulating layers as they are formed. In such instances, one length of tape is commonly applied centrally to each package and extends completely around the package. If no backing sheet is employed, preferably two tapes are applied to each package to maintain proper pressure on the compressed insulating strips.

The strips can be packaged in a variety of widths, as determined by the location of slitting knives on the forming line. Widths of nominal 15 inches or 23 inches are common and two, three, or even more of the strips of one width or of a variety of widths can be simultaneously packaged in side-by-side relationship. Consequently, the tapes applied to the packages must be able to be dispensed from a variety of positions across the supply conveyor for the packaging machine. The tapes also must be dispensed from closely-spaced positions at times, as when they are to be applied near the adjacent edges of two 15-inch wide packages.

Heretofore, tapes could only be dispensed from a few selected positions across the conveyor. Also, the dispensers were limited as to the extent they could be closely spaced to one another. Consequently, with dispensers heretofore known, it was not possible to apply the tapes in all instances to the desired locations on each of a variety of packages.

The present invention provides improved tape-dispensing apparatus which overcomes the above-outlined previous problems. The apparatus includes individual dispensers which can be employed to dispense tape from a variety of positions across a supply conveyor of a packaging machine. Likewise, the new dispensers can be spaced more closely together than those previously known. Several or all of the dispensers of the new apparatus are driven by a common drive which is separate from the dispensers and which reduces the size of each dispenser and enables closer spacing of them. The drive in a preferred form is an elongate drive member or spline which is carried on a frame extending substantially across the width of the supply conveyor. The individual dispensers have separate means for engaging any portions of the spline along the length thereof. Hence, the dispensers can be located anywhere across the width of the supply conveyor for the packaging machine.

It is, therefore, a principal object of the invention to provide apparatus for dispensing flexible elongate material from substantially any location across a conveyor.

Another object of the invention is to provide apparatus for dispensing elongate, flexible material with the dispensers being positionable more closely together than heretofore.

A further object of the invention is to provide a plurality of dispensers having a common drive for dispensing a plurality of tapes.

Other objects and advantages of the invention will be apparent from the following detailed description of a preferred embodiment thereof, reference being made to the accompanying drawings, in which.

Figures 1, 2, 3, 4:
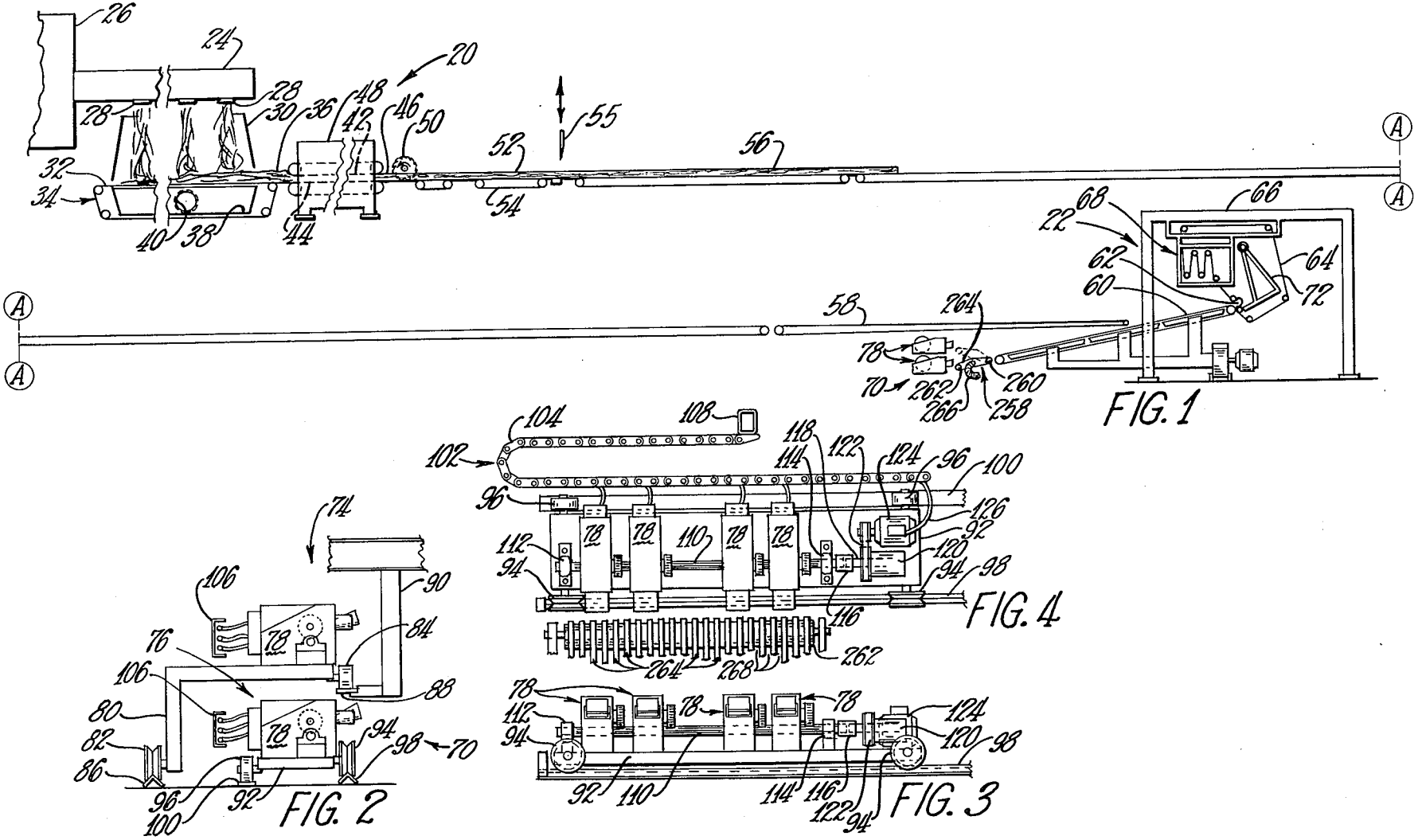
FIG. 1 is an overall schematic, side view in elevation of a line for forming strips of insulation and for winding them into compressed packages.
FIG. 2 is an enlarged end view of tape-dispensing apparatus for the line shown in FIG. 1.
FIG. 3 is a front view of a lower bank of tape dispensers of FIG. 2.
FIG. 4 is a top view of the lower bank of the dispensers.

Referring to FIG. 1, a production or forming line on which a compressible fibrous strip, and specifically building insulation, can be produced is indicated at 20. Packaging apparatus for packaging compressible fibrous strips, whether of long lengths or of shorter lengths, commonly known as batts, is indicated at 22. The production line 20 is of a substantially known design and will be discussed only briefly. Accordingly, a forehearth 24 receives heat-softened glass or other flowable, fiber-forming material from a melting furnace 26 in which raw batch material is reduced to a flowable or molten state. The molten glass or other material is fed to fiber-forming units 28 located beneath the forehearths 24 from which fibers are formed. For example, each of the units 28 can be a hollow, rotatable member or spinner having orifices in the periphery through which molten glass is attenuated into primary fibers are further attenuated and directed downwardly by hot gaseous blasts from blowers or burners (not shown) located around the units 28. The fibers are then moved downwardly through a forming hood 30 and are coated with binder by suitable spray devices (not shown) which direct the binder into the forming hood transversely of the path of the fibers.

The sprayed fibers are randomly disposed on a flight 32 of a foraminous, endless belt conveyor 34, the fibers being collected as a mass or layer 36 of approximate desired thickness. The layer 36 of fibers is carried along the conveyor 34 while a suction chamber 38, located below the flight 32 of the conveyor, holds the fibers on the flight 32 by means of a vacuum provided by an exhaust conduit 40 connected to a suction blower (not shown). The suction assists in carrying away the spent gases of the attenuating blasts and also air-borne organic particles from the binder.

The layer 36 of the fibers is then advanced to a region between upper and lower foraminous belts 42 and 44 which are positioned so as to compress the fibers somewhat into a smoother fibrous layer or body 46 of a given thickness. The foraminous belts 42 and 44 convey the fibrous layer through an oven or heating chamber 48 in which the binder is set or partially cured on the fibers at a temperature in the order of 450°–500° F. When the layer 46 emerges from the oven, the edges are trimmed by rotatable knives 50 which remove uneven strips therefrom. Further, additional ones of the rotatable knives 50 can be used to sever the formed layer 46 into two or more narrower fibrous layers or strips 52. For a conveyor about 48 inches wide, by way of example, the layer 46 can be severed into three 15-inch wide strips or two 23-inch wide strips. Various other combinations of strips can also be formed by the knives, depending upon the conveyor width and the desired end product.

A plow (not shown) can then be used to spread apart the narrow layers or strips 52 slightly so that a coated kraft paper or similar backing sheet can be applied to the lower surface of each of the layers or strips, being fed upwardly from underneath as is known in the art. The layers 52, with or without the backing sheets, are then carried along a conveyor 54 and under a cut-off knife 55 which cuts the layers 52 into insulating strips 56 of given lengths. The strips can be quite long, in the order of 50–75 feet, by way of example, or can be of shorter lengths of 93 or 96 inches, by way of example, commonly known as batts, which are designed to fit between studs of a building wall and have lengths substantially equal to the stud lengths.

Heretofore, the insulating strips 56 were fed directly into a roll-type packaging machine or were removed from the line downsteam of the cut-off knife 55 by hand and packaged in a batt-type packaging machine, depending upon the length. However, the insulating strips 56 can now be packaged by the packaging machine 22 automatically as they are discharged from the end of the forming line and, specifically, from the end of a final conveyor 58 thereof. The insulating strips are carried up an inclined, supply conveyor 60 and into a loop 62 formed in an endless belt 64 carried by a main frame 66 of the machine. The belt 64 is generally driven in a clockwise direction as viewed in FIG. 1 and is maintained under controlled tension by tensioning means indicated at 68. As the strips are fed up the conveyor 60 and into the loop 62, they are rotated in a counterclockwise direction into a spiral configuration and are simultaneously compressed by virtue of the tension on the belt 64. As the strips continue to feed into the loop 62, the loop size increases but still maintains tension on the strips. As the trailing ends of the strips or the last batts in the series being packaged are fed toward the machine 22, tapes are dispensed from tape-dispensing apparatus indicated at 70 below the conveyor 58 and in front of the supply conveyor 60. The tapes are fed up the conveyor 60 and into the loop 62 around the outer surface of each of the packages so that the strips are held in the compressed state by the tapes. At this time, the packages are completed and an inner framework 72 of the machine pivots in a counterclockwise direction to open or straighten the loop 62 and discharge the completed packages therefrom.

A packaging machine of this type is disclosed more fully in a U.S. patent application of Miller et al, Ser. No. 500,795, and will not be discussed in further detail.

The tape-dispensing apparatus 70 includes upper and lower banks 74 and 76 (FIG. 2) of tape dispensers 78. The upper bank 74 has an L-shaped main frame 80 movably mounted on wheels 82 and 84 which engage rails 86 and 88, the former being on the floor and the latter mounted on a framework 90. The lower bank 76 has a main frame 92 movably mounted on wheels 94 and 96 which are engageable with rails 98 and 100 located on the floor. The two banks 74 and 76 of dispensers with their movable mounting arrangement enable one bank to be pulled out to the side of the conveyor 60 for loading or repair while the other bank is in operation. Other than the main frames, the two banks 74 and 76 are similar and only the lower bank 76 will be discussed in detail.

A supply harness 102 (FIG. 4) for each of the banks 74 and 76 comprises a link chain 104 which carries flexible lines for electrical power, air, and water for each dispenser bank. Certain air and water lines connect to headers 106 (FIG. 2) carried by the banks; one end of each chain is anchored by a frame member 108 (FIG. 4).

An elongate drive member or spline 110 extends longitudinally of the main frame 92 and is rotatably supported by bearing blocks 112 and 114; intermediate bearings can also be employed where desirable. The spline 110 preferably has a length about equal to the width of the supply conveyor 60 so that the dispensers 78 can be positioned substantially anywhere over the width, as will be discussed more fully subsequently. The spline 110 is connected by a coupling 116 to a shaft 118 of an air clutch 120. The clutch 120 in turn is driven through a belt 122 by an electric motor 124 mounted near one end of the frame 92. Power for the motor 124 is supplied through a cord 126 which is carried by the link chain 104.

By way of example, when the belt 64 has a width of about 46 inches, six of the dispensers 78 preferably are mounted on each of the banks 74 and 76; when the belt 64 has a 76-inch width, ten of the dispensers 78 are on each of the banks 74 and 76. However, only four dispensers are shown for simplicity of illustration. With each of the banks having or being capable of carrying six of the dispensers, the packaging machine 22 can package three side-by-side insulating strips, each having a nominal width of fifteen inches, with two tapes applied to the outer surface near the edges of each of the packaged strips. When two strips each having a nominal width of 23 inches, by way of example, are packaged in the machine 22, then two of the dispensers 78 can be removed and the other four positioned to apply the tape to edge portions of the two 23 inch wide insulation packages.

Figure 5:
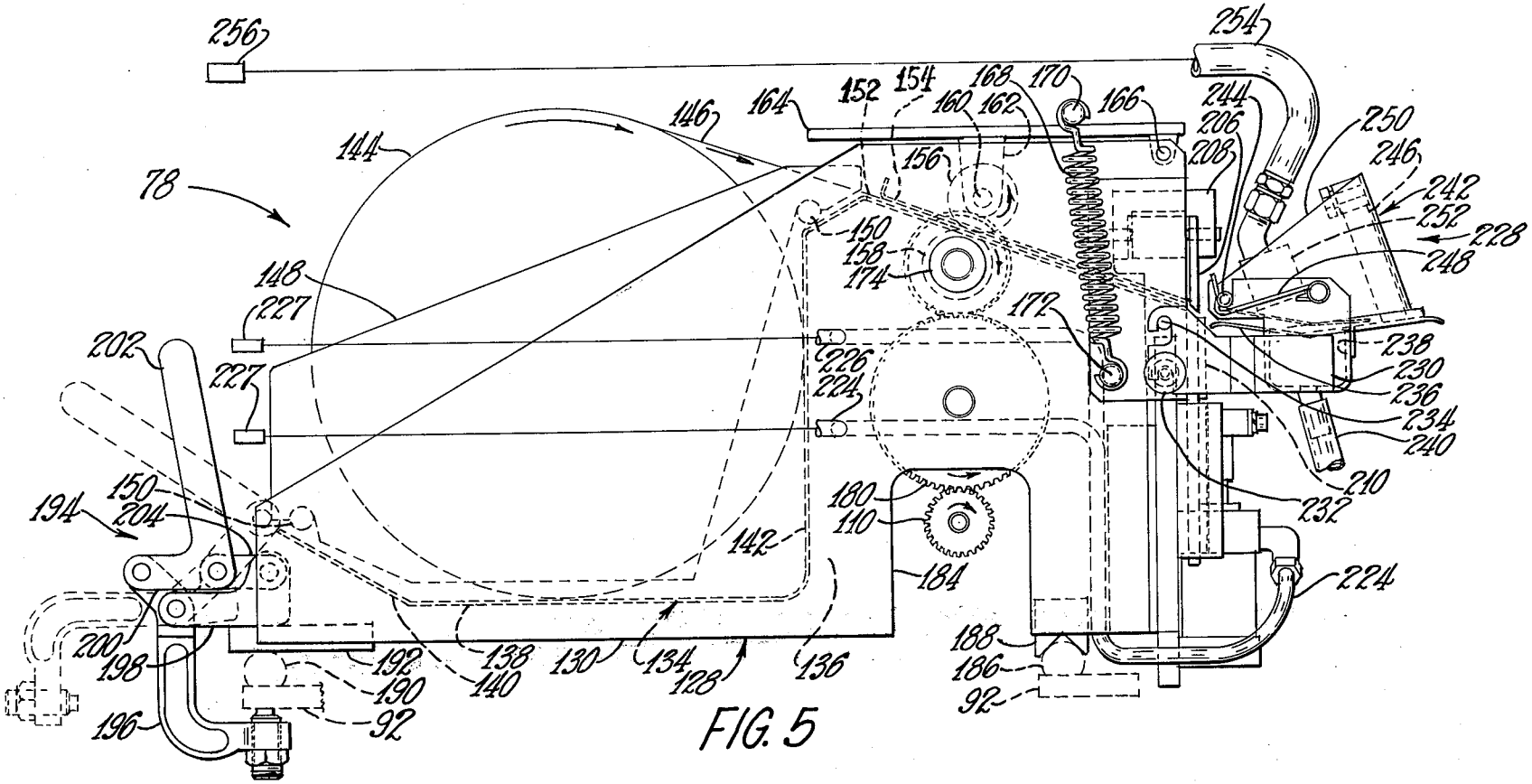
FIG. 5 is a greatly enlarged side view of one of the tape dispensers embodying the invention.
Figure 6:
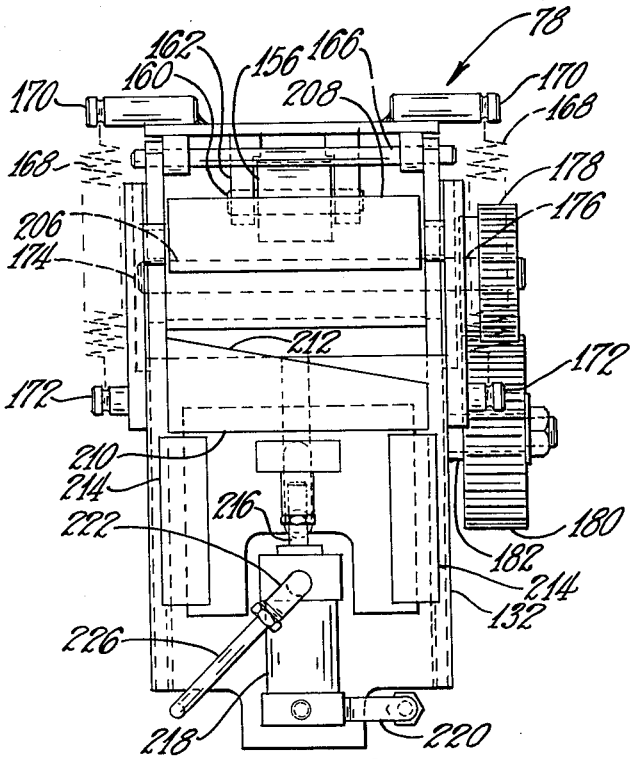
FIG. 6 is a front view of the tape dispenser of FIG. 5, with components thereof removed.
Figure 7:
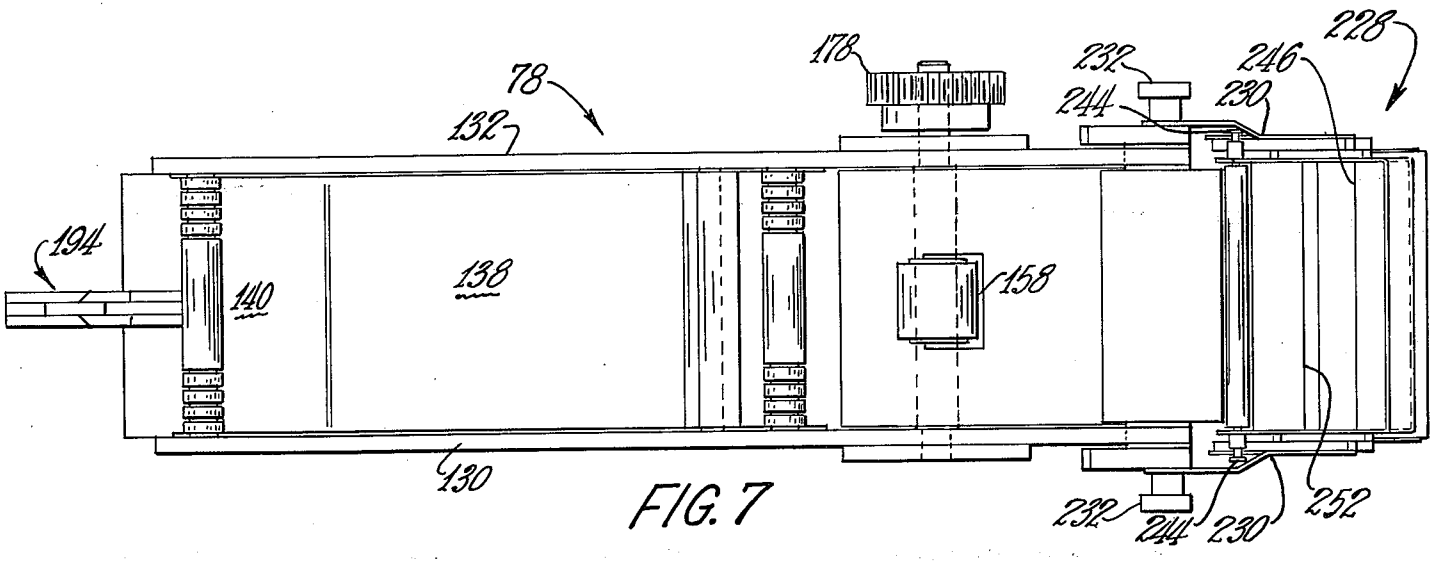
FIG. 7 is a plan view of the dispenser of FIG. 5.

Referring more particularly to FIGS. 5–7, each of the dispensers 78 includes a main housing 128 formed by side plates or walls 130 and 132 with a contoured, transversely-extending web indicated at 134 therebetween. The web 134 has transversely-extending walls 136, 138, and 140 which forms a pocket or recess 142 for a roll 144 of tape 146. Tape-spacing plates 148 are located in the pocket 142 between the side plates 130 and 132 and the roll 144 to help guide and retain the tape roll 144. The spacing plates are mounted on transverse supports 150.

The tape 146 is directed down a chute formed by a slanted transverse wall 152 above which is a hold-down plate 154 to hold the tape flat. An upper pressure roll 156 extends through an opening in the hold-down plate 154 and engages the top of the tape 146 while a lower drive roll 158 extends through an opening in the slanted wall 152 and engages the lower surface of the tape 146. The upper pressure roll 156 is mounted on an axle 160 which is carried by depending tabs 162 extending downwardly from a lid 164. The lid 164 is hinged by pins 166 to upper corner portions of the side plates 130 and 132. The lid is urged downwardly by side coil springs 168 connected between pins 170 affixed to and extending outwardly from the side edges of the lid 164 and pins 172 extending outwardly from the side plates 130 and 132. The springs 168 thereby keep pressure on the tape 146 through the roll 156 which in turn keeps the tape firmly engaged with the drive roll 158.

The drive roll 158 has an axle 174 which is rotatably carried by the side plate 130 and also has a shaft 176 (FIG. 6) which extends through the side plate 132 and has a spur gear 178 affixed thereto. The gear 178 meshes with a connecting or driven gear 180 located therebelow and rotatably carried on a stub-shaft 182 extending from the side plate 132. As shown in FIG. 5, the connecting gear 180 also extends below the upper ends of notches 184 which are formed in the lower edges of the side plates 130 and 132 and is engaged by the drive spline 110. The connecting gear 180 meshes with but is not supported on the drive spline 110.

To support the dispensers 78 relative to the main frame 92 and the spline 110, the main frame has a forward positioning rod 186 having a curved upper surface which is engaged by inverted V-blocks 188 affixed to the side plates 130 and 132. Another supporting rod 190 is located on a rear portion of the frame 92 and a mounting block 192 extending between the side plates 130 and 132 rests on this rod. Thus, the weight of the dispenser 78 is supported on the rods 186 and 190 while the cooperation of the front rod 186 with the V-blocks 188 positions the dispenser transversely to provide proper cooperation between the drive spline 110 and the connecting gear 180.

To hold the dispenser 78 in position on the frame 92, an over-center clamp indicated at 194 can be employed. The over-center clamp 194 includes a pivotal jaw 196 engageable with the lower surface of the frame 92, being pivotally carried by an ear 198 affixed to the supporting plate 192. The pivotal jaw 196 has an upper end pivotally connected to a rearwardly-extending portion 200 of a handle 202 which is pivoted to an upper portion of the ear 198 through an articulated link 204. With this arrangement, the handle 202 can be moved from the solid line position of FIG. 5 to the dotted line position to correspondingly move the pivotal jaw 196 to the dotted line position and release the dispenser 78. The dispenser 78 can then be moved transversely of the supply conveyor 60 to any desired position relative thereto and the clamp 194 engaged again to hold the dispenser in position. Thus, it will be readily seen that the dispenser 78 can be spaced anywhere along the bank 76 to dispense the tapes at any desired position.

To dispense the tape 146 from the dispenser 78, the clutch 120 can be energized by an electric eye or other sensing means suitably placed relative to the conveyor 58 and actuated when the trailing edge of the last insulating strip being packaged passes the electric eye. The motor 124 then rotates the spline 110 and drives the roller 158. The tape is dispensed from the forward end of the dispenser until a timer times out to deenergize the clutch 120 and energize a brake. After an additional predetermined delay, the tape is severed at the front end of the dispenser with a portion of the tape still being engaged between the rolls 156 and 158 to be ready for the next cycle.

For the purpose of severing the tape 146 to a determinant length, a stationary cutting blade 206 (FIGS. 5 and 6) is located at the forward end of the dispenser 78, being carried by a mounting bracket 208. The lower cutting edge of the blade 208 is located immediately above the tape 146 as it exits from the dispenser 78. A lower, movable blade 210 has an upper slanted cutting edge 212 which cooperates with the stationary blade 208 to sever the tape when the blade 210 is moved upwardly. For this purpose, the blade 210 is positioned between side guides 214 and is connected to a piston rod 216 of a piston (not shown) located in a fluid-operated cylinder 218. Actuating fluid is supplied through a fitting 220 to the blind end of the cylinder 218 to move the blade 210 upwardly, and is supplied through a fitting 222 to the rod end of the cylinder to retract the blade 210. Fluid such as air is supplied through a line 224 (FIG. 5) to the lower fitting 220 and is supplied through a line 226 (FIG. 6) to the upper fitting 222. These lines can be connected back to the headers 106 through quick-disconnect couplings 227.

The tape 146 is dispensed with the adhesive side facing upwardly, the adhesive preferably being a water-activated one. To activate the adhesive, a brush assembly 228 is located at the front end of the dispenser 78. The assembly 228 includes side brackets 230 mounted on the side plates 130 and 132 by pins 232 and 234. The brackets 230 have a discharge platform 236 positioned to receive the tape 146 just below the stationary blade 206. The discharge 236 has holes therein which communicate with a drain sump 238 located therebelow, which in turn connects with a suitable drain line 240.

A brush holder 242 is pivotally carried by the side brackets 230 through pins 244 and carries a brush 246 at the forward end, the pins 244 being held by spring clips 248. The weight of the brush 246 does not rest directly on the tape 146 but, rather, side plates 250 of the holder 242 rest upon side edges of the discharge platform 236. A spray nozzle block 252 directs water onto the brush 246 which distributes it onto the upper adhesive side of the tape 146. Water for the nozzle block 252 is supplied through a line 254 from the headers 106 through a quick-disconnect coupling 256.

Referring to FIGS. 1 and 4, a transfer conveyor 258 serves to transfer the tape 146 from the operating bank 74 or 76 to the supply conveyor 60. The conveyor 258 includes a head pulley 260 which is located in a fixed position and is driven by a suitable motor (not shown). The conveyor also includes a tail pulley 262 which can be moved up and down by means of a pneumatic cylinder, by way of example, to receive tapes from either of the banks of dispensers. The conveyor 258 pivots about the head pulley 260 as it moves from one bank to the other.

A multiplicity of narrow belts 264 extend around the pulleys 260 and 262 and are closely spaced so that the tape 146 can be received on the conveyor 258 at any point across the width thereof. A vacuum is established in the space between the pulleys and within the belts by a vacuum line 266 connected to a vacuum blower (not shown). The belts are actually positioned in channels (not shown) which guide the belts and support them to take off the load of the air. A vacuum is thus established within the belts and air is drawn through narrow spaces or slots 268 between the channels so as to hold the tapes 146 on the conveyor 258 as they are transferred from the operating bank to the supply conveyor 60. The belts 264 are narrower than the tapes 146 so that the tapes will always be held by the suction in the sots 208.

Various modifications of the above-described embodiment of the invention will be apparent to those skilled in the art and it is to be understood that such modifications can be made without departing from the scope of the invention if they are within the spirit and the tenor of the accompanying claims.

I claim:

1. Apparatus for dispensing tape from any position along a given path which is transverse to the direction in which the tape is dispensed, said apparatus comprising a frame, an elongate drive member supported on said frame and having a length at least substantially equal to the length of the path, a tape dispenser housing supported on said frame at any point along the drive member, said housing having a driven member rotatably carried thereby and engageable with said elongate drive member at substantially any position therealong, and a tape drive roll driven by said driven member and positioned to engage and dispense tape from a supply thereof carried by said housing.

2. Tape-dispensing apparatus according to claim 1 characterized by clamp means associated with said housing for releasably attaching said housing to said frame in any desired position along said drive member.

3. Tape-dispensing apparatus according to claim 1 characterized by said frame and said housing having cooperating positioning means for positioning said driven member in an engageable position relative to said elongate drive member.

4. Tape-dispensing apparatus according to claim 3 characterized by said cooperating positioning means comprises a rod member having a curved upper surface on said frame and an inverted V-shaped member carried by said housing.

5. Tape-dispensing apparatus according to claim 1 characterized by said driven member being positioned to one side of said tape dispenser housing.

6. Tape-dispensing apparatus according to claim 1 characterized by means downstream of said tape drive roll for severing the tape to determinant lengths.

7. Tape-dispensing apparatus according to claim 6 characterized by said severing means comprises a stationary blade positioned above the path of the tape, a movable blade having a retracted position below the path of the tape and an upper position extending beyond the path of the tape and adjacent the stationary blade, and means for moving said movable blade between the retracted position and the upper position.

8. Tape-dispensing apparatus according to claim 6 characterized by brush means downstream of said severing means for applying liquid to the upper surface of the tape.

9. Tape-dispensing apparatus according to claim 1 characterized by said elongate drive member comprising a spline, said driven member comprising a gear engageable with said spline.

10. Tape-dispensing apparatus according to claim 1 characterized by a pressure roll carried by said housing and positioned to engage the side of the tape opposite said drive roll, and resilient means carried by said housing for urging said pressure roll toward said drive roll.

11. Tape-dispensing apparatus according to claim 1 characterized by said frame having a plurality of wheels, and rails engagable by said wheels for moving said frame in a direction parallel to said elongate drive member.

12. Apparatus for dispensing tapes onto a conveyor at any point across the width thereof, said apparatus comprising an upper frame extending at least a substantial distance across the width of the conveyor, an upper tape dispenser on said frame and operable from any position over a substantial portion of the length of the frame, a lower frame parallel to the upper frame and extending at least a substantial distance across the width of the conveyor, a lower tape dispenser on said lower frame and operable from any position over a substantial portion of the length of the lower frame, a suction conveyor having a head pulley and a tail pulley, and having a plurality of belts extending around said head pulley and said tail pulley, means for supporting said tail pulley in a fixed position, and means for moving said head pulley between a position aligned with the upper tape dispenser and a position aligned with the lower tape dispenser.

13. Apparatus according to claim 12 characterized by said upper frame having an upper elongate drive member extending therealong, and said upper tape dispenser having means for moving the tape longitudinally, and means connecting said tape-moving means and said elongate drive member for operating said tape-moving means from said elongate drive member.

14. Apparatus according to claim 12 characterized by said lower frame having an elongate drive member extending therealong, and said lower tape dispenser having means for moving the tape longitudinally, and means connecting said tape-moving means and said elongate drive member for operating said tape-moving means from said elongate drive member.

15. Apparatus according to claim 13 characterized by said lower frame having a lower elongate drive member extending therealong, and said lower tape dispenser having lower means for moving the tape longitudinally and means connecting said lower tape-moving means and said lower elongate drive member for operating said lower tape-moving means from said lower elongate drive member.

16. Apparatus according to claim 15 characterized by said upper and lower elongate drive members being parallel to one another.

17. Apparatus according to claim 12 characterized by each of said belts having a width less than the width of the tape to be dispensed.

18. Apparatus according to claim 17 characterized by suction means forming a vacuum below the upper run of said belts, said belts being spaced close together but having slots therebetween through which air tends to be pulled by said suction means.

19. Apparatus according to claim 12 characterized by each of said upper and lower tape dispensers having severing means for severing the tapes to determinant lengths.

20. Apparatus according to claim 19 characterized by each of said dispensers having means for wetting the upper surfaces of the tapes downstream of said severing means.

21. Apparatus according to claim 12 characterized by there being a plurality of the upper tape dispensers on said upper frame and there being a plurality of the lower tape dispensers on said lower frame.

22. Apparatus according to claim 21 characterized by each of said upper tape dispensers having independent means engageable with common drive means carried by said upper frame for moving tape carried by the corresponding dispenser in a longitudinal direction, and each of said lower tape dispensers having independent means engageable with common drive means carried by said lower frame for moving tape carried by the corresponding dispenser in a longitudinal direction.

23. Apparatus according to claim 22 wherein each of said common drive means comprises an elongate spline.

24. Apparatus according to claim 22 characterized by each of said dispensers having releasable means for positioning the dispenser in a fixed position relative to its respective frame.

25. Tape-dispensing apparatus comprising a housing having a recess for holding a roll of tape, a tape drive roll rotatably carried by said housing and positioned to engage the tape and move it in a longitudinal direction, and a driven member mechanically connected to said drive roll and having a portion positioned relative to said housing for engagement with a drive member, an elongate drive member engageable with said driven member and extending beyond both sides of said housing, said drive member being separate and separable from said housing, severing means carried by said housing for severing the tape downstream of said tape drive roll, and means on said housing to aid in supporting said housing in a fixed position relative to the drive member.

26. Tape-dispensing apparatus according to claim 25 characterized by a brush located downstream of said severing means and engageable with an upper surface of the tape, and means for supplying water to said brush.

27. Tape dispensing apparatus according to claim 26 characterized by said water-applying means comprises spray nozzle means directed toward said brush.

28. Tape dispensing apparatus according to claim 25 characterized by a pressure roll carried by said housing and positioned to engage the tape on the side opposite said drive roll.

29. Tape dispensing apparatus according to claim 28 characterized by spring means for urging said pressure roll toward said drive roll.

30. Tape dispensing apparatus according to claim 28 characterized by said dispenser having a lid positioned above said pressure roll and carrying said pressure roll, and spring means connected to said lid for urging said pressure roll toward said drive roll.

31. Tape dispensing apparatus according to claim 25 characterized by said housing forming a recess in a lower edge thereof to receive the drive member, and said driven member extending into said recess.

* * * * *